US009284876B2

(12) United States Patent
Bidner et al.

(10) Patent No.: US 9,284,876 B2
(45) Date of Patent: Mar. 15, 2016

(54) SYSTEM AND METHOD FOR COOLING ENGINE PISTONS

(71) Applicant: Ford Global Technologies, LLC, Dearborn, MI (US)

(72) Inventors: David Karl Bidner, Livonia, MI (US); Joseph Norman Ulrey, Dearborn, MI (US); Yihua (Eva) Barber, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 15 days.

(21) Appl. No.: 13/789,134

(22) Filed: Mar. 7, 2013

(65) Prior Publication Data

US 2014/0251240 A1 Sep. 11, 2014

(51) Int. Cl.
*F01P 3/08* (2006.01)

(52) U.S. Cl.
CPC ..... *F01P 3/08* (2013.01); *F01P 2025/60* (2013.01)

(58) Field of Classification Search
CPC ..... F01M 1/08; F01P 3/08; F01P 3/06; F01P 1/04; F01P 2060/04; F02F 3/16
USPC ..... 123/41.35, 41.45, 41.64, 41.73, 436; 701/101–105
See application file for complete search history.

(56) References Cited

U.S. PATENT DOCUMENTS

| | | | | |
|---|---|---|---|---|
| 4,037,999 | A | 7/1977 | Armin et al. | |
| 4,667,630 | A * | 5/1987 | Sasaki | 123/254 |
| 6,742,481 | B2 | 6/2004 | Baldwin | |
| 7,347,846 | B2 * | 3/2008 | Hermansson et al. | 604/385.3 |
| 7,669,559 | B2 * | 3/2010 | Aoyama et al. | 123/48 B |
| 7,823,545 | B2 | 11/2010 | Arvan et al. | |
| 8,171,912 | B2 * | 5/2012 | Glugla et al. | 123/305 |
| 8,256,388 | B2 * | 9/2012 | Aixala | 123/41.35 |
| 8,347,846 | B2 * | 1/2013 | Kobayashi et al. | 123/196 R |
| 8,387,571 | B2 * | 3/2013 | Ulrey et al. | 123/41.35 |
| 2004/0187835 | A1 * | 9/2004 | Hoff et al. | 123/196 R |
| 2005/0120982 | A1 * | 6/2005 | Ducu | 123/41.08 |
| 2012/0138010 | A1 * | 6/2012 | Ulrey et al. | 123/196 R |
| 2012/0227705 | A1 * | 9/2012 | Ashizawa | 123/435 |
| 2013/0139768 | A1 * | 6/2013 | Takemoto | 123/41.02 |
| 2013/0179049 | A1 * | 7/2013 | Grieser et al. | 701/102 |

* cited by examiner

*Primary Examiner* — Lindsay Low
*Assistant Examiner* — Long T Tran
(74) *Attorney, Agent, or Firm* — Julia Voutyras; Alleman Hall McCoy Russell & Tuttle LLP

(57) ABSTRACT

An engine cooling system and method for operating the engine cooling system is disclosed. In one example, engine oil is sprayed on to a piston via piston cooling jets. The approach judges whether or not to operate the piston cooling jets based on a benefit assessment. The approaches may be suitable for systems that include a variable oil pump.

19 Claims, 3 Drawing Sheets

SYSTEM AND METHOD FOR COOLING ENGINE PISTONS

BACKGROUND/SUMMARY

Temperature of an engine internal component may vary with engine operating conditions. One engine component temperature that varies with engine operating conditions is engine piston temperature. For example, piston temperature may vary with engine speed, load, combustion timing, fuel type, fuel injection timing, and other conditions. At higher engine loads, end gases in an engine cylinder may combust after an initial spark in the cylinder, but before being ignited by a flame produced by the spark. The end gases may begin to combust as a result of being exposed to higher piston temperatures. Consequently, the engine may knock and engine component degradation may result. One way to reduce piston temperature and the possibility of knock is to spray engine oil on the bottom sides of pistons. The oil conducts heat away from the piston, thereby cooling the piston. The heated oil returns to the oil pan via gravity where it may be cooled. However, engine energy is used to spray oil on the pistons and engine fuel economy may decrease when engine oil is sprayed on pistons.

The inventors herein have recognized the above-mentioned disadvantages and have developed a method for operating an engine, comprising: operating a piston cooling jet in response to an engine torque difference between operating at a borderline spark while operating the piston cooling jet at an engine speed and load, and operating at a borderline spark while not operating the piston cooling jet at the engine speed and load.

By selectively operating a piston cooling jet in response to an engine torque difference between operating at a borderline spark while operating the piston cooling jet at an engine speed and load, and operating at a borderline spark while not operating the piston cooling jet at the engine speed and load, it may be possible to conserve fuel by not operating the piston cooling jet when operating the piston cooling jet provides little benefit. On the other hand, the piston cooling jet may be operated when operating the piston cooling jet provides more useful benefit.

The present description may provide several advantages. For example, the approach may improve engine fuel economy. Additionally, the approach may provide piston cooling during conditions where it provides a significant benefit. Further, the approach may be useful for engine systems that do or do not include individual control of piston cooling jets.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
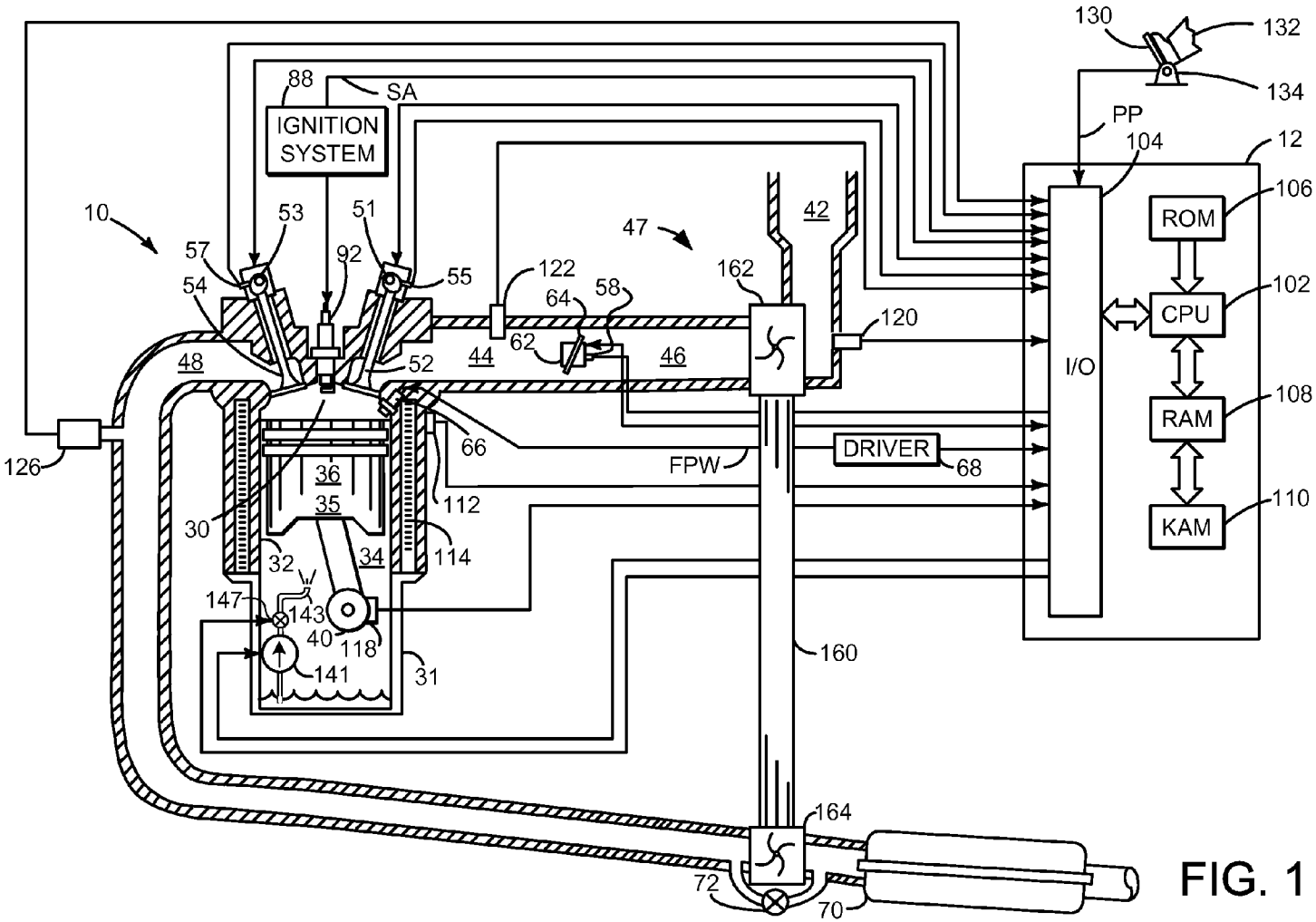
FIG. 1 shows a schematic depiction of an engine and piston cooling jet system.
Figure 2:
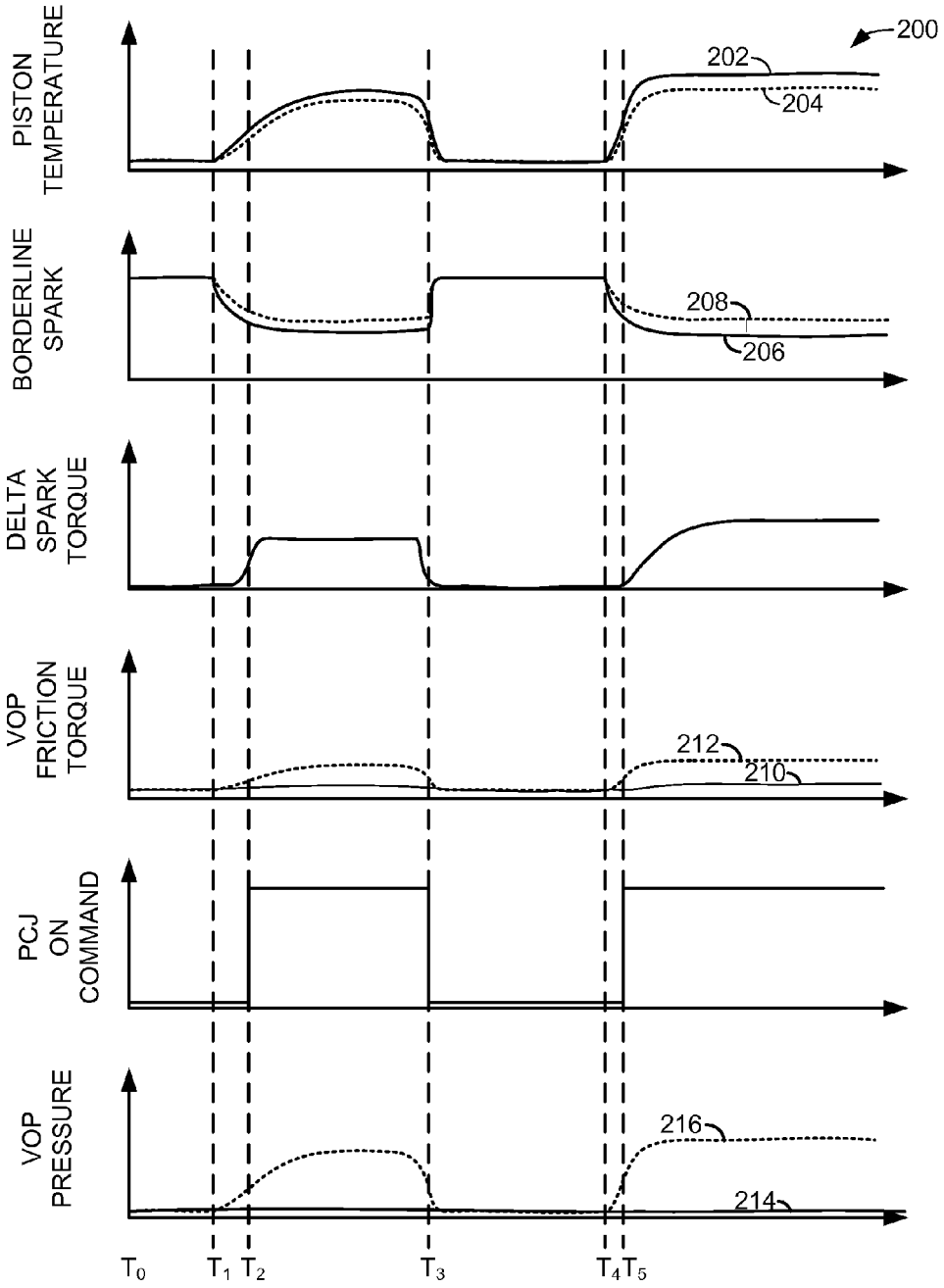
FIG. 2 shows simulated signals of interest during vehicle operation.
Figure 3:
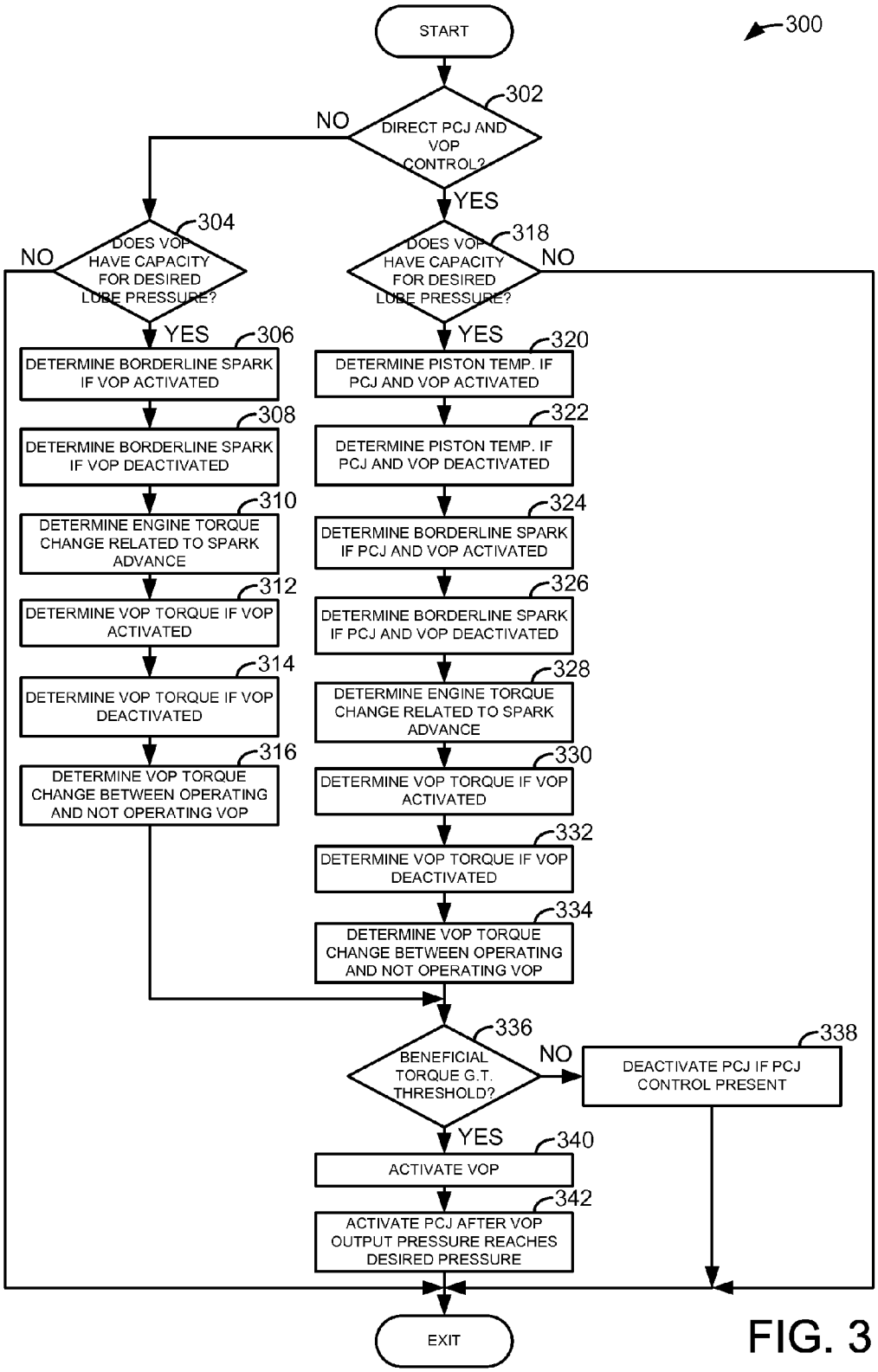
FIG. 3 shows a flowchart of a method for operating an engine including piston cooling jets.

The present description is related to cooling engine pistons via engine oil. FIG. 1 shows one example system for cooling engine pistons. Engine pistons may be cooled via spraying oil on a bottom side of the pistons. Piston heat is transferred to the oil and the oil is returned to an oil pan where it is cooled. FIG. 2 shows example signals of interest when operating an engine that includes piston cooling jets. FIG. 3 is a flowchart of a method for operating an engine that includes piston cooling jets.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Piston 36 includes a bottom side 35 where oil may be sprayed via piston cooling jet 143. Piston cooling jet 143 may be supplied with engine oil via valve 147 and variable output oil pump 141. Valve 147 and output of oil pump 141 are controlled by controller 12. Piston 36 is also mechanically coupled to crankshaft 40 via a connecting rod.

Crankshaft 40 is located within crankcase 34. Crankcase 34 is at least partially enclosed via oil pan 31. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from intake boost chamber 46 to intake manifold 44.

Compressor 162 draws air from air intake 42 to supply boost chamber 46. Exhaust gases spin turbine 164 which is coupled to compressor 162 via shaft 160. Vacuum operated waste gate actuator 72 allows exhaust gases to bypass turbine 164 so that boost pressure may be controlled under varying operating conditions.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, non-transitory read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a knock sensor for determining ignition of end gases (not shown); a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC).

In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft.

Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

The system of FIG. 1 provides for an engine system, comprising: a piston; a piston cooling jet selectively spraying oil on the piston; an oil pump supplying oil to the piston cooling jet; and a controller including executable non-transitory instructions for varying an output of the oil pump in response to a difference in engine torques. The engine system includes where the difference in engine torques is a difference between a difference in engine friction torques and a difference in engine borderline torques at an engine speed and load. The engine system further comprises instructions for not activating the piston cooling jets in response to the oil pump lacking capacity to deliver a desired lube pressure. The engine system includes where the oil pump is a variable output oil pump and further comprising additional instructions for not increasing the output of the oil pump when the difference in engine torques is less than a threshold. The engine system includes where the oil pump is a variable output oil pump and further comprising additional instructions for increasing the output of the oil pump when the difference in engine torques is greater than a threshold. The engine system further comprises additional instructions for not activating the piston cooling jets in response to the oil pump lacking capacity to deliver a desired lube pressure.

Referring now to FIG. 2, simulated signals of interest during engine operation are shown. Vertical markers $T_0$-$T_5$ identify particular times of interest during the operating sequence. Similar signals may be observed when the method of FIG. 3 is executed by controller 12 of FIG. 1.

The first plot from the top of FIG. 2 shows piston temperature versus time. Time starts at the left side of the plot and increases to the right. Piston temperature is lowest at the X axis and it increases in the direction of the Y axis arrow. Solid line 202 represents piston temperature with piston cooling jets off. Dashed line 204 represents piston temperature with piston cooling jets on.

The second plot from the top of FIG. 2 shows borderline spark timing versus time. Time starts at the left side of the plot and increases to the right. Borderline spark is least advanced from top-dead-center compression stroke at the X axis and it advances in the direction of the Y axis arrow. Solid line 206 represents borderline spark with piston cooling jets off. Dashed line 208 represents borderline spark with piston cooling jets on.

The third plot from the top of FIG. 2 shows a change or difference in engine torque between operating the engine with piston cooling jets activated and operating the engine with piston cooling jets not activated versus time. Time starts at the left side of the plot and increases to the right. Torque is lowest at the X axis and it increases in the direction of the Y axis arrow.

The fourth plot from the top of FIG. 2 shows variable oil pump (VOP) friction torque versus time. Time starts at the left side of the plot and increases to the right. VOP friction torque increases in the direction of the Y axis. Solid line 210 represents VOP friction torque with piston cooling jets off. Dashed line 210 represents VOP friction torque with piston cooling jets on.

The fifth plot from the top of FIG. 2 shows piston cooling jet (PCJ) on command versus time. Time starts at the left side of the plot and increases to the right. The PCJ is activated by opening a solenoid valve (e.g., valve 147 of FIG. 1) when the PCJ on command trace is at a higher level. The PCJ is not activated when the PCJ command trace is at a lower level.

The sixth plot from the top of FIG. 2 shows variable oil pump (VOP) output pressure versus time. Time starts at the left side of the plot and increases to the right. The VOP output pressure increases in the direction of the Y axis arrow. Solid line 214 represents VOP friction torque with piston cooling jets off. Dashed line 216 represents VOP friction torque with piston cooling jets on.

In plots that have two traces, the dashed line is at the same level as the solid line when only the solid line is visible.

At time $T_0$, estimated piston temperatures are at a lower levels and borderline spark is advanced indicating that the engine is operating at a lower engine speed and load. The change in engine torque between operating the engine with piston cooling jets activated and operating the engine with piston cooling jets not activated is at a low level indicating that there is not much difference in engine torque whether or not the piston cooling jets are activated at the present engine operating conditions. Therefore, the PCJ is commanded off and the VOP pressure is commanded to a lower level.

At time $T_1$, the estimated piston temperature begins to increase and the borderline spark timing is retarded to a less advanced timing relative to top-dead-center compression stroke and engine crankshaft timing. Such conditions may be representative of the engine transitioning to a higher load condition. The change in engine torque between operating the engine with piston cooling jets activated and operating the engine with piston cooling jets not activated gradually begins to increase responsive to borderline spark timing differences between operating the engine with and without activated piston cooling jets. The estimated VOP friction torque and estimated VOP pressure due to operating the engine at higher engine load conditions with piston cooling jets activated begin to increase. The piston cooling jets are not commanded to an on state where oil is sprayed on the bottom of an engine piston since estimated VOP pressure for activated piston cooling jets is low. Thus, the VOP output may be commanded to increase oil pressure before the piston cooling jets are activated.

At time $T_2$, the estimated piston temperature is increased further and the borderline spark timing is retarded to a less advanced timing relative to top-dead-center compression stroke and engine crankshaft timing. The change in engine torque between operating the engine with piston cooling jets activated and operating the engine with piston cooling jets not activated further increases responsive to borderline spark timing differences between operating the engine with and without activated piston cooling jets. The VOP friction torque increases and VOP output pressure estimate also increases. The change in engine torque operating between operating the engine with active piston cooling jets and operating the engine without piston cooling jets is greater than the increase in VOP friction torque. Therefore, the piston cooling jet command is adjusted to an activated level and piston cooling begins in response to the difference between VOP friction torque and engine torque related to borderline spark.

At time $T_3$, the estimated piston temperature begins to decrease and the borderline spark timing is advanced relative to top-dead-center compression stroke and engine crankshaft timing. Such conditions may be representative of the engine transitioning to a lower load condition. The change in engine torque between operating the engine with piston cooling jets activated and operating the engine with piston cooling jets not activated gradually begins to decrease responsive to borderline spark timing differences between operating the engine with and without activated piston cooling jets. The estimated VOP friction torque and estimated VOP pressure due to operating the engine at lower engine load conditions with piston cooling jets activated begin to decrease. The piston cooling jets are commanded to an off state where oil is not sprayed on the bottom of an engine piston. Thus, the VOP output may be commanded to decrease oil pressure so as to reduce friction related torque losses in the engine.

At time $T_4$, the estimated piston temperature begins to increase again and the borderline spark timing is retarded to a less advanced timing relative to top-dead-center compression stroke and engine crankshaft timing. Such conditions may be representative of the engine transitioning to a higher speed and load condition. The change in engine torque between operating the engine with piston cooling jets activated and operating the engine with piston cooling jets not activated increases responsive to borderline spark timing differences between operating the engine with and without activated piston cooling jets. The estimated VOP friction torque and estimated VOP pressure due to operating the engine at higher engine speed and load conditions with piston cooling jets activated also begin to increase. The piston cooling jets are not commanded to an on state where oil is sprayed on the bottom of an engine piston since estimated VOP pressure for activated piston cooling jets is low.

At time $T_5$, the estimated piston temperature is increased further and the borderline spark timing is retarded to a less advanced timing relative to top-dead-center compression stroke and engine crankshaft timing. The change in engine torque between operating the engine with piston cooling jets activated and operating the engine with piston cooling jets not activated further increases responsive to borderline spark timing differences between operating the engine with and without activated piston cooling jets. The VOP friction torque increases and VOP output pressure estimate also increases. The change in engine torque between operating the engine with active piston cooling jets and operating the engine without piston cooling jets is greater than the increase in VOP friction torque. Therefore, the piston cooling jet command is adjusted to an activated level and piston cooling begins. The piston cooling jets are activated at a same VOP pressure as compared to when piston cooling jets are activated at time $T_2$, but the time interval between beginning to increase VOP pressure and piston cooling jet activation is reduced since VOP pressure reaches a desired pressure sooner.

Referring now to FIG. 3, a high level flowchart for operating an engine is shown. The method of FIG. 3 may be provided via executable instructions stored in non-transitory memory of controller 12 of FIG. 1. The method of FIG. 3 may also provide the sequence shown in FIG. 2.

At 302, method 300 judges whether or not piston cooling jets (PCJ) and variable oil pump (VOP) controls are available. If so, the answer is yes and method 300 proceeds to 318. Otherwise, the answer is no and method 300 proceeds to 304. If the answer is no, only VOP may be available.

At 318, method 300 judges whether or not the VOP has capacity to provide a desire lube pressure (e.g., desired oil pump output pressure). The VOP output capacity may be limited by engine speed, oil temperature, or other conditions. In one example, the VOP capacity is estimated based on empirically determined data stored in controller memory and that is indexed via engine speed, oil temperature, and oil consumers receiving oil from the VOP. If The VOP has the capacity to provide the desired lube pressure, the answer is yes and method 300 proceeds to 320. Otherwise, the answer is no and method 300 proceeds to exit.

At 320, method 300 estimates piston temperature if the PCJs and VOP are activated to spray oil at the piston. In one example, the piston temperature is estimated based on empirically determined data stored in a table or function in memory and that is indexed via engine temperature, engine speed, engine load, and spark timing when PCJs and the VOP are activated. Method 300 proceeds to 322 after piston temperature for activated PCJ and VOP is determined.

At 322, method 300 estimates piston temperature if the PCJs and VOP are not activated to spray oil at the piston. In one example, the piston temperature is estimated based on empirically determined data stored in a table or function in memory and that is indexed via engine temperature, engine speed, engine load, and spark timing when PCJs and the VOP are not activated. Method 300 proceeds to 324 after piston temperature for deactivated PCJ and VOP is determined.

At 324, method 300 determines borderline spark (e.g., a minimum spark advance timing for a particular engine speed and load where engine knock begins) for conditions where PCJs and VOP are activated at the present engine speed and load. Alternatively, the PCJs may be deactivated and the VOP operated at a lower output pressure as compared to when the PCJs are operated. In one example, for activated PCJ and VOP, borderline spark is empirically determined and stored in a table or function that is indexed via piston temperature from 320, engine speed, and engine load. Thus, the borderline spark for activated PCJ and VOP accounts for piston temperature cooling that PCJ and VOP provide. Method 300 proceeds to 326 after borderline spark for activated PCJ and VOP is determined.

At 326, method 300 determines borderline spark for conditions where PCJs and VOP are not activated or where the VOP is operated at a lower output capacity at the present engine speed and load. In one example, for inactivate PCJ and VOP, borderline spark is empirically determined and stored in a table or function that is indexed via piston temperature from 322, engine speed, and engine load. Thus, the borderline spark for deactivated PCJ and VOP accounts for piston temperature when PCJ and VOP are not activated to provide piston cooling. Method 300 proceeds to 328 after borderline spark for deactivated PCJ and VOP is determined.

At 328, method 300 determines engine torque change related to borderline spark advance timing. In one example, the engine torque change related to spark advance is based on a first borderline spark where PCJ and VOP are activated and a second borderline spark where PCJ and VOP are deactivated or the VOP is operated with a lower output pressure. In particular, a function that stores empirically determined engine torque estimation modifiers that outputs a value that is multiplied by the present engine indicated torque to determine an engine torque change related to borderline spark advance timing. In one example, the function is indexed based on engine speed and a difference between borderline spark for conditions where PCJs and VOP are not activated at the present engine speed and load and borderline spark for conditions where PCJs and VOP are activated at the present engine speed and load. Thus, the function is indexed via the present engine speed and the present difference between two borderline spark timings, one borderline spark timing where PCJ and VOP are active and one borderline spark timing where PCJ and VOP are not active. Method 300 proceeds to 330 after the engine torque change related to borderline spark timing is determined.

At 330, method 300 determines VOP torque if VOP and PCJ are activated. In one example, method 300 estimates VOP torque via tables or functions that hold empirically determined torques related to VOP operation. In particular, VOP torque estimation includes a base VOP torque that is based on engine speed plus modifiers for VOP pressure and engine oil temperature. VOP torque increases with increasing VOP output pressure, decreasing oil temperature, and increasing engine speed. VOP torque decreases with decreasing VOP output pressure, increasing oil temperature, and decreasing engine speed. Method 300 proceeds to 332 after VOP torque is determined.

At 332, method 300 determines VOP torque if VOP and PCJ are not activated. Alternatively, the VOP may be operated at a lower output pressure than when the PCJs are operating. In one example, method 300 estimates VOP torque via tables or functions that hold empirically determined torques related to a deactivated VOP. In particular, VOP torque estimation includes a base VOP torque that is based on engine speed plus modifiers for VOP pressure and engine oil temperature. VOP torque increases with increasing VOP output pressure, decreasing oil temperature, and increasing engine speed. VOP torque decreases with decreasing VOP output pressure, increasing oil temperature, and decreasing engine speed. VOP torque for a deactivated VOP is lower than torque for an activated VOP. Method 300 proceeds to 334 after VOP torque is determined.

At 334, method 300 determines VOP torque change between operating the VOP and not operating the VOP at present engine operating conditions. In particular, the VOP torque determined at 332 is subtracted from the VOP torque determined at 330. Method 300 proceeds to 336 after the VOP torque change is determined.

At 336, method 300 judges whether the beneficial torque provided by operating the VOP and PCJ is greater than a threshold amount of torque. In particular, the VOP torque change determined at 334 is subtracted from the engine torque change related to spark advance determined at 328. If the result is greater than a predetermined torque, the answer is yes and method 300 proceeds to 340. Otherwise, the answer is no and method 300 proceeds to 338.

At 338, method 300 deactivates PCJs and the VOP. The PCJs may be deactivated via closing a valve that regulates oil flow from the VOP to the PCJs. The VOP may be deactivated via commanding zero oil pressure. If the VOP supplies oil to other engine components, the VOP output pressure may be commanded to a lower output pressure as compared to if the VOP were supplying oil to the PCJ. Method 300 proceeds to exit after the PCJ is deactivated and after the VOP is deactivated or commanded to a lower output pressure.

At 340, method 300 activates the VOP. The VOP may be activated to supply oil to the PCJ via increasing VOP output pressure. The VOP output pressure is increased based on the desired number of active PCJs, oil temperature, engine speed, engine load, and piston temperature. Method 300 proceeds to 342 after the VOP is activated.

At 324, method 300 activates the PCJ after VOP output pressure reaches a desired pressure. By waiting to reach a desired output pressure, the PCJs may be activated such that they spray oil with sufficient velocity to reach the piston so that oil pressure may build faster than if the VOP and PCJs where activated simultaneously. Although in some instances, the VOP and PCJs may be activated simultaneously. Method 300 proceeds to exit after the VOP and PCJs are activated.

At 304, method 300 judges whether or not the VOP has capacity to provide a desire lube pressure (e.g., desired oil pump output pressure). The VOP output capacity may be limited by engine speed, oil temperature, or other conditions. In one example, the VOP capacity is estimated based on empirically determined data stored in controller memory and that is indexed via engine speed, oil temperature, and oil consumers receiving oil from the VOP. If The VOP has the capacity to provide the desired lube pressure, the answer is yes and method 300 proceeds to 306. Otherwise, the answer is no and method 300 proceeds to exit.

At 306, method 300 determines borderline spark (e.g., a minimum spark advance timing for a particular engine speed and load where engine knock begins) for conditions where the VOP is activated at the present engine speed and load. In one example, for activated VOP without individual PCJ control, borderline spark is empirically determined and stored in a table or function that is indexed via engine speed, and engine load. Thus, the estimated borderline spark for activated VOP without individual PCJ control includes less information as the estimate provided at 320. Method 300 proceeds to 308 after borderline spark for activated VOP is determined.

At 308, method 300 determines borderline spark for conditions where the VOP are not activated or operated at a lower output capacity at the present engine speed and load. In one example, for inactivate VOP, borderline spark is empirically determined and stored in a table or function that is indexed via engine speed and engine load. Thus, the borderline spark for deactivated VOP is simplified as compared to a similar determination at 326. Method 300 proceeds to 310 after borderline spark for deactivated VOP is determined.

At 310, method 300 determines engine torque change related to borderline spark advance timing. In one example, the engine torque change related to spark advance is based on a first borderline spark where the VOP is activated and a second borderline spark where the VOP is deactivated. In particular, a function that stores empirically determined engine torque estimation modifiers that outputs a value that is multiplied by the present engine indicated torque to determine an engine torque change related to borderline spark advance timing. In one example, the function is indexed based on engine speed and a difference between borderline spark for conditions where the VOP is not activated at the present engine speed and load and borderline spark for conditions where the VOP is activated at the present engine speed and load. Thus, the function is indexed via the present engine speed and the present difference between two borderline spark timings. One borderline spark timing is for an active VOP, the other borderline spark timing is for a deactivated VOP or operating the VOP at a lower output capacity. Method 300 proceeds to 312 after the engine torque change related to borderline spark timing is determined.

At 312, method 300 determines VOP torque if VOP is activated. In one example, method 300 estimates VOP torque via tables or functions that hold empirically determined torques that are related to VOP operation. In particular, VOP torque estimation includes a base VOP torque that is based on engine speed plus modifiers for VOP pressure and engine oil temperature. VOP torque increases with increasing VOP output pressure, decreasing oil temperature, and increasing engine speed. VOP torque decreases with decreasing VOP output pressure, increasing oil temperature, and decreasing engine speed. Method 300 proceeds to 314 after VOP torque is determined.

At 314, method 300 determines VOP torque if VOP is not activated or operating at a lower output capacity. In one example, method 300 estimates VOP torque via tables or functions that hold empirically determined torques that are related to a deactivated VOP. In particular, VOP torque estimation includes a base VOP torque that is based on engine speed plus modifiers for VOP pressure and engine oil temperature. VOP torque increases with increasing VOP output pressure, decreasing oil temperature, and increasing engine speed. VOP torque decreases with decreasing VOP output pressure, increasing oil temperature, and decreasing engine speed. VOP torque for a deactivated VOP is lower than torque for an activated VOP. Method 300 proceeds to 316 after VOP torque is determined.

At 316, method 300 determines VOP torque change between operating the VOP and not operating the VOP at present engine operating conditions. In particular, the VOP torque determined at 314 is subtracted from the VOP torque determined at 312. Method 300 proceeds to 336 after the VOP torque change is determined.

In this way, PCJs and VOP may be selectively operated to provide improve engine fuel efficiency and piston cooling. The benefits of activating the PCJs and VOP are weighed against the efficiency loss of operating the PCJs and the VOP.

Thus, the method of FIG. 3 provides for operating an engine, comprising: operating a piston cooling jet in response to an engine torque difference between operating at a borderline spark while operating the piston cooling jet at an engine speed and load, and operating at a borderline spark while not operating the piston cooling jet at the engine speed and load. The method includes where the piston cooling jet sprays engine oil to a bottom side of a piston. The method includes where the piston cooling jet is operated via increasing output of an oil pump.

In some examples, the method includes where the piston cooling jet is operated via opening a valve between an oil pump and the piston cooling jet. The method further comprises a piston temperature model, and estimating the borderline spark while operating the piston cooling jets based on an output from the piston temperature model. The method further comprises estimating an engine oil pump output capacity and estimating whether or not the engine oil pump output has capacity to meet a desired engine lubrication pressure. The method also further comprises operating the piston cooling jets when the engine oil pump has capacity to meet the desired engine lubrication pressure and when the engine torque difference is greater than a threshold torque. The method includes where operating the piston cooling jet is further responsive to a beneficial engine torque.

In another example, the method of FIG. 3 provides for operating an engine, comprising: operating engine cooling jets in response to an engine friction torque difference between operating engine cooling jets at an engine speed and load, and not operating engine cooling jets at the engine speed and load. The method further comprises operating the engine cooling jets responsive to an engine torque difference between operating at a borderline spark while operating the piston cooling jets at an engine speed and load, and operating at a borderline spark while not operating the piston cooling jets at the engine speed and load.

In another example, the method of FIG. 3 further comprises operating the engine cooling jets responsive to a difference between the engine friction torque difference and the engine torque difference. The method includes where the difference between the engine friction torque difference and the engine torque difference is an estimate of beneficial torque. The method includes where the engine cooling jets are operated when the beneficial torque is greater than a threshold torque. The method includes where engine cooling jets are operated via a valve between an engine oil pump and the engine cooling jets.

As will be appreciated by one of ordinary skill in the art, the methods described in FIG. 3 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. A method for operating an engine, comprising:

operating a piston cooling jet in response to an engine torque difference between operating at a borderline spark while operating the piston cooling jet at an engine speed and load, and operating at a borderline spark while not operating the piston cooling jet at the engine speed and load.

2. The method of claim 1, where the piston cooling jet sprays engine oil to a bottom side of a piston.

3. The method of claim 1, where the piston cooling jet is operated via increasing output of an oil pump.

4. The method of claim 1, where the piston cooling jet is operated via opening a valve between an oil pump and the piston cooling jet.

5. The method of claim 1, further comprising a piston temperature model, and estimating the borderline spark while operating the piston cooling jet based on an output from the piston temperature model.

6. The method of claim 1, further comprising estimating an engine oil pump output capacity and estimating whether or not the engine oil pump output has capacity to meet a desired engine lubrication pressure.

7. The method of claim 6, further comprising operating the piston cooling jet when the engine oil pump has capacity to meet the desired engine lubrication pressure and when the engine torque difference is greater than a threshold torque.

8. The method of claim 1, where operating the piston cooling jet is further responsive to a beneficial engine torque.

9. A method for operating an engine, comprising:

operating engine cooling jets in response to an engine friction torque difference between operating engine cooling jets at an engine speed and load, and not operating engine cooling jets at the engine speed and load; and operating the engine cooling jets responsive to an engine torque difference between operating at a borderline spark while operating piston cooling jets at an engine speed and load, and operating at a borderline spark while not operating the piston cooling jets at the engine speed and load.

10. The method of claim 9, further comprising operating the engine cooling jets responsive to a difference between the engine friction torque difference and the engine torque difference.

11. The method of claim 10, where the difference between the engine friction torque difference and the engine torque difference is an estimate of beneficial torque.

12. The method of claim 11, where the engine cooling jets are operated when the beneficial torque is greater than a threshold torque.

13. The method of claim 9, where the engine cooling jets are operated via a valve between an engine oil pump and the engine cooling jets.

14. An engine system, comprising:

a piston;

a piston cooling jet selectively spraying oil on the piston;

an oil pump supplying oil to the piston cooling jet; and a controller including executable non-transitory instructions for adjusting the oil pump to vary output of the oil pump in response to a determined difference between two engine torques.

15. The engine system of claim 14, where the determined difference between two engine torques is a difference in torques determined at engine borderline spark timings at an engine speed and load.

16. The engine system of claim 15, further comprising instructions for not activating the piston cooling jet in response to the oil pump lacking capacity to deliver a desired lube pressure.

17. The engine system of claim 15, where the oil pump is a variable output oil pump and further comprising additional instructions for not increasing the output of the oil pump when the difference between two engine torques is less than a threshold.

18. The engine system of claim 15, where the oil pump is a variable output oil pump and further comprising additional instructions for increasing the output of the oil pump when the difference between two engine torques is greater than a threshold.

19. The engine system of claim 15, further comprising additional instructions for not activating the piston cooling jet in response to the oil pump lacking capacity to deliver a desired lube pressure.

* * * * *